United States Patent [19]

Milius et al.

[11] Patent Number: 4,684,550

[45] Date of Patent: Aug. 4, 1987

[54] ELECTROLESS COPPER PLATING AND BATH THEREFOR

[75] Inventors: John W. Milius, Mars; Jill D. Alderson, Harmony, both of Pa.

[73] Assignee: Mine Safety Appliances Company, Pittsburgh, Pa.

[21] Appl. No.: 856,009

[22] Filed: Apr. 25, 1986

[51] Int. Cl.[4] ..... C23C 18/40

[52] U.S. Cl. ..... 427/437; 106/1.23; 106/1.26; 427/98; 427/443.1

[58] Field of Search ..... 106/1.23, 1.26; 427/443.1, 437

[56] References Cited

U.S. PATENT DOCUMENTS

| | | | |
|---|---|---|---|
| Re. 29,285 | 6/1977 | Christin | 427/305 |
| 3,870,526 | 3/1975 | Pearlstein | 106/1.23 |
| 4,143,186 | 3/1979 | Davis | 106/1.23 |
| 4,371,397 | 2/1983 | Honma | 106/1.23 |

OTHER PUBLICATIONS

Pearlstein, "Electroless Copper Plating Using Dimethylamine Borane", Plating, May 1973, pp. 474–476.

*Primary Examiner*—John D. Smith

[57] ABSTRACT

Electroless copper is plated from aqueous plating baths comprising a soluble copper salt, ethylenediamine tetraacetic acid, dimethylamine borane, thiodyglycolic acid and a surfactant reaction product of ethylene oxide and an acetylenic glycol.

7 Claims, No Drawings

ELECTROLESS COPPER PLATING AND BATH THEREFOR

FIELD OF THE INVENTION

This invention relates to electroless copper plating and more particularly to a plating bath containing a copper salt and dimethylamine borane, and a method of plating copper from the bath.

BACKGROUND OF THE INVENTION

Electroless copper plating on a variety of substrates has been used, for example, in the manufacture of printed circuit boards. The baths conventionally contain a soluble copper salt, a copper complexing or chelating agent, a reducing agent and stabilizer and brightener additives. Early baths using sodium hypophosphite reducing agent are quite stable but have very low plating rates. Baths using formaldehyde reducing agent, now widely used, have faster plating rates but less stability than the hypophosphite baths. It is desirable to avoid formaldehyde baths because of the toxic hazard of formaldehyde in the workplace. Cyanides have frequently been used as complexing agents and they also present a toxic hazard and disposal difficulties.

Electroless copper plating tends to be self-limiting as plating stops, or is drastically slowed, as a significant thickness of plate is deposited. Conventionally in the manufacture of printed circuit boards, copper is electroplated over a thin strike of electroless copper. There is a need for an electroless copper plating bath of sufficient stability and turnover life that plates rapidly enough to plate the entire thickness of copper on the printed circuit boards, suitably to a thickness of 1 mil or more.

Dimethylamine borane has also been used as reducing agent in electroless copper plating baths. Pearlstein and Wightman, U.S. Pat. No. 3,370,526 and *Plating,* Vol. 60, No. 5, pp. 474–6, May 1973, deposited copper strikes from a bath containing copper sulfate, EDTA disodium salt, DMAB, and ammonium hydroxide. Arisato and Korijama, U.S. Pat. No. 4,138,267 disclosed baths with borane reducing agents, hydroxyl substituted ethylenediamine copper-complexing agents, adjusted to 12 to pH14 with alkali hydroxide, and containing cyanide or ferrocyanide stabilizers. Dimethylamine borane has also been used in acid or neutral electroless copper plating baths: U.S. Pat. No. 4,143,186 and U.S. Pat. No. 3,431,120.

BRIEF DESCRIPTION OF THE INVENTION

This invention is based on our discovery of an electroless copper plating bath, free of formaldehyde and cyanides, that is extremely stable and is also capable of depositing thick plates at a rapid rate. If plating is interrupted, plating can be reinitiated with no loss of plate integrity. The plate is a high purity copper plate that does not require surface preparation for overplating, as, for example, with electroless nickel. The baths also are easily replenished and have a long turnover life.

The baths of my invention consist essentially of an aqueous solution of a soluble copper salt, ethylenediamine tetraacetic acid (EDTA), dimethylamine borane, thiodiglycolic acid, a surfactant reaction product of ethylene oxide and an acetylenic glycol, and sufficient ammonium hydroxide to adjust the pH between about 8.0 and 11.5. It is essential to obtain practical stability that the bath does not contain alkali metal ions.

In the use of the bath, a substrate to be plated, with the surface prepared by any of the conventional methods, is immersed in the solution maintained at a temperature sufficient to give the desired plating rate but below that at which the bath spontaneously decomposes. The bath is suitable for use in plating injection-molded printed circuit boards, EMI/RFI shielding of plastics, additive printed circuit boards, semi-additive printed circuit boards and flexible printed circuit boards.

DETAILED DESCRIPTION OF THE INVENTION

Typically the baths are formulated at the time of use by mixing two solutions. A copper solution contains copper salt, complexing agent, stabilizer, surfactant and ammonium hydroxide; the reducer solution contains the reducing agent. The proportions of materials are adjusted to give the desired concentrations in the final mixed bath and the pH is adjusted by the addition of ammonium hydroxide.

Copper sulfate (hydrate) is preferred, primarily because it is inexpensive, but generally any soluble copper salt can be used to provide copper ions to the bath, such as, for example, copper halides, copper nitrate and copper acetate. It is used in amounts to give a concentration, on a dry salt basis, in the mixed plating bath of between about 0.6 and 6.4 g/l. A preferred bath contains about 3.2 g/l.

The complexing agent is EDTA in an amount to give a concentration in the plating bath of between about 6 and 50 g/l; a preferred bath contains about 12.25 g/l. The commonly used disodium salt of EDTA should not be used in baths of this invention.

Bath stability is provided by the use of a particular combination of a stabilizer and surfactant. The stabilizer is thiodiglycolic acid, $S(CH_2CO_2H)_2$, (TDGA) at a plating bath concentration between about 2.5 and 50 mg/l; a preferred bath contains about 10 mg/l. Stabilizers, including sulfur containing stabilizers, used to diminish the persistent problem of spontaneous bath decomposition are known to have the undesirable effect of decreasing or, with very slight changes in concentration, completely stopping plating action. When used in combination with the other ingredients in the bath, thiodiglycolic acid does not noticeably inhibit the plating rate. The concentration of the stabilizer can be varied over a fairly wide range, as noted above, without poisoning the bath. This characteristic makes replenishment much easier, as the stabilizer concentration does not have to be precisely adjusted in each turnover.

The surfactant is an adduct of ethylene oxide and an acetylenic glycol in which $—O—CH_2—CH_2—$ groups are inserted in the C—OH bond. The Surfynol® 400 series surfactants, available from Air Products and Chemicals, Inc. are particularly suitable. They are adducts of ethylene oxide and 2,4,7,9-tetra-methyl-5-decyne-4,7-diol, having the formula

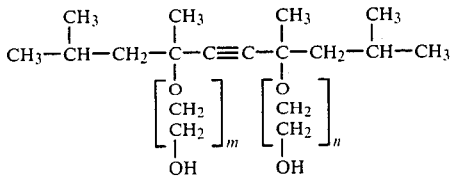

where m+n ranges from about 3.5 to 30, (that is, from about 40 to 85 weight percent ethylene oxide). Surfactant concentration in the plating bath is between about 2.5 and 1000 mg/l; a preferred bath contains about 11 mg/l. Baths with thiodiglycolic stabilizer and the adduct surfactant also give a brighter plate with a more even color than baths using conventional copper bath stabilizers.

The reducing agent is dimethylamine borane (DMAB), used in plating bath concentrations between about 2.5 and 12.5 g/l; a preferred bath contains about 5.5 g/l.

The pH of the bath is adjusted with ammonium hydroxide to between about 8.0 and 11.5, preferably between about 9.5 and 10.5. To preserve bath stability, sodium hydroxide or other alkalis should not be used.

It wil be recognized that the bath composition changes, with plating, particularly by the consumption of copper ion and DMAB in the plating reaction, and the formation of plating reaction by-products. The ability of the bath to accommodate reaction products without adversely affecting plating performance is of great practical significance, as it determines the number of times a bath can be successfully replenished and reused.

EXAMPLE 1

A 38 l, pH 10 bath was made up in the proportion of 5.0 g/l of $CuSO_4.5H_2O$, 12.25 g/l of EDTA, 10 mg/l of TDGA, 11 mg/l of Surfonyl 485, about 50 ml/l of $NH_4OH$ and 5.5 g/l of DMAB. In conventional fashion, the bath was contained in a polypropylene tank, mildly air agitated, with a recirculating slip stream passing through a 5 micron polypropyelene filter bag, and heated to 65° C. with Teflon immersion heaters. Five plaques of commercial FR-4 fiberglass-resin circuit board material, surface treated by conventional palladium-tin sensitization, including immersion in an accelerator bath to remove excess tin from the plaque, were immersed in the bath and one plaque was removed from the bath at each of the times indicated for measurement of the plate thickness by $\beta$-back scatter:

| Time (hr) | Plate Thickness ($\mu$in) | Plating Rate $\mu$in/hr. |
|---|---|---|
| 1 | 209 | 209 |
| 2 | 395 | 198 |
| 3 | 619 | 206 |
| 4 | 776 | 194 |
| 5 | 787 | 157 |

Another plaque was immersed in the plating bath and periodically removed at the times indicated for measurement of the plate thickness, rinsed and returned to the bath:

| Time (hr) | Plate Thickness ($\mu$in) | Plating Rate $\mu$in/hr. |
|---|---|---|
| 1 | 186 | 186 |

-continued

| Time (hr) | Plate Thickness ($\mu$in) | Plating Rate $\mu$in/hr. |
|---|---|---|
| 2 | 375 | 188 |
| 3 | 598 | 199 |
| 4 | 735 | 184 |
| 5 | 861 | 172 |

Pre-etched polycarbonate panels, sensitized by palladium-tin sensitization, were immersed in the bath and plated to a thickness of about 1 mil:

Panel 1 (3"×6")—1086 $\mu$in plate in 9.2 hours
Panel 2 (5"×8")—1000 $\mu$in plate in 8.9 hours
Panel 3 (5"×8")—1016 $\mu$in plate in 8.6 hours.

The average plating rate for the three panels was 116 $\mu$in per hour.

EXAMPLE 2

An FR-4 panel pretreated in EXAMPLE 1, was plated at 68° C. in a 200 ml bath formulated as in EXAMPLE 1. The initial plating rate was 193 $\mu$in/hr and after five hours the bath showed no indications of instability or plate out on the container. At 25° C. the bath plated at a rate of 31 $\mu$in/hr, and at 80° C. at a rate of 186 $\mu$in/hr. After plating at 80° C., the bath was heated to 95° C. and showed no indication of instability. The baths thus tolerate high temperatures without spontaneous decomposition, but there appears to be no advantage in plating rate by increasing the temperature above about 65° C.

Comparison Example. A 200 ml bath was formulated as in EXAMPLE 2, but not containing TDGA and Surfynol. A panel as in EXAMPLE 2 was immersed in the bath at 68° C. and plated at a rate of 103 $\mu$in/hr until the bath spontaneously decomposed after 61 minutes.

EXAMPLE 3

A 500 ml bath was formulated as in EXAMPLE 1. and an FR-4 panel, surface treated as above, was immersed for plating at 68° C. for a period of 3 hours at an average plating rate of 139 $\mu$in/hr. There was no indication of bath instability during plating and during a cooling and standing period over a weekend.

Comparison Example. A 500 ml bath was formulated as in EXAMPLE 3, except 12.25 g/l of disodium salt of EDTA was used in place of EDTA. A panel was plated at 68° C. for 3 hours at an average rate of 157 $\mu$in/hr. However, after 130 minutes bath instability was indicated by the formation of copper nodules that precipitated from the bath; after cooling and standing over the weekend, as in EXAMPLE 3, there was continued nodule formation and the bath color had lightened, showing significant loss (over 50%) of copper ion.

EXAMPLE 4

A 38 l bath was made up as in EXAMPLE 1 and coupons were plated at 65°-68° C. through numerous replenishments. After the metal ion of the bath was depleted about 10-20%, the bath was replenished by adding deionized water and ammonium hydroxide to bring the bath to original volume and pH, adding sufficient copper solution to replenish copper ion and enough reducer solution to replenish the dimethylamine borane. The concentrated reducer replenishing solution contained 110 g DMAB per liter and the copper replenishing solution contained 200 g of $CuSO_4.5H_2O$, 400 mg of TDGA and 300 mg of Surfonyl 485 per liter. Plating was carried out for about 6–8 hours each day, and the bath was allowed to sit at room temperature overnight, and over one weekend. After 7 days, and 5.2 turnovers, the bath was filtered and stored for later use. One turnover is equivalent to one replacement of the entire original metal content of the bath. The average coupon plating rate was 191 μin/hr.

The plate formed in using baths of this invention are high purity copper, typically, 99.9% Cu, 0.08% B, and have a density of about 8.92 g/cc. They are bright, smooth and have excellent solderability.

It will be recognized that, within the scope of the claims, this invention can be practiced other than as specifically exemplified.

I claim:

1. An electroless copper plating bath substantially free of alkali metal ions and consisting essentially of an aqueous solution of (1) about 0.6 to 6.4 g/l of a water soluble copper salt,
(2) about 6 to 50 g/l of ethlenediamine tetraacetic acid,
(3) about 2.5 to 12.5 g/l of dimethylamine borane,
(4) about 2.5 to 50 mg/l of thiodiglycolic acid,
(5) about 2.5 to 1000 mg/l of a surfactant reaction product of ethylene oxide and an acetylenic glycol, and
(6) sufficient ammonium hydroxide to adjust the pH between about 8.0 and 11.5.

2. A bath according to claim 1 in which the acetylenic glycol is 2,4,7,9 tetra-methyl-5-decyne-4,7-diol.

3. A bath according to claim 1 in which the copper salt is copper sulfate.

4. A bath according to claim 2 in which the copper salt is copper sulfate.

5. A bath according to claim 1 having a pH between 9.5 and 10.5 and containing about 3.2 g/l of copper sulfate, about 12 g/l ethylene diamine tetraacetic acid, about 5.5 g/l of dimethylamine borane, about 10 mg/l of thiodiglycolic acid, and about 11 mg/l of a surfactant adduct of ethylene oxide and 2,4,7,9-tetra-methyl-5-decyne-4,7 diol.

6. A method for the electroless deposition of copper on a substrate comprising contacting the substrate with an aqueous bath at a temperature between about 25° C. and 80° C., the bath being substantially free of alkali metal ions and containing (1) about 0.6 to 6.4 g/l a water soluble copper salt,
(2) about 6 to 50 g/l of ethylenediamine tetraacetic acid,
(3) about 2.5 to 12.5 g/l of dimethylamine borane,
(4) about 2.5 to 500 mg/l of thiodiglycolic acid,
(5) about 2.5 to 1000 mg/l of a surfactant reaction product of ethylene oxide and an acetylenic glycol, and
(6) sufficient ammonium hydroxide to adjust the pH between about 8.0 and 11.5.

7. A method according to claim 6 in which the bath has a pH between about 9.5 and 10.5 and contains about 3.2 g/l of copper sulfate, about 12 g/l ethylene diamine tetraacetic acid, about 5.5 g/l of dimethylamine borane, about 10 mg/l of thiodiglycolic acid, and about 11 mg/l of a surfactant adduct of ethylene oxide and 2,4,7,9-tetra-methyl-5-decyne-4,7 diol.

* * * * *